US006148449A

United States Patent [19]

Gübeli

[11] Patent Number: 6,148,449

[45] Date of Patent: Nov. 21, 2000

[54] FLUSHING MEANS AT A LAVATORY INSTALLATION HAVING A TOILET BOWL

[75] Inventor: Albert Gübeli, Jona, Switzerland

[73] Assignee: Geberit Technik AG, Jona, Switzerland

[21] Appl. No.: 09/275,914

[22] Filed: Mar. 24, 1999

[30] Foreign Application Priority Data

Mar. 24, 1998 [CH] Switzerland ..... 686/98

[51] Int. Cl.[7] ..... E03D 1/34

[52] U.S. Cl. ..... 4/378

[58] Field of Search ..... 4/353, 378, 420; 251/4, 5

[56] References Cited

U.S. PATENT DOCUMENTS

| | | | |
|---|---|---|---|
| 716,315 | 12/1902 | Wales | 4/420 X |
| 1,977,797 | 10/1934 | Kohler et al. | 4/420 |
| 2,769,397 | 11/1956 | Bolger | 251/5 X |
| 4,006,497 | 2/1977 | Mollerstedt | 4/420 |
| 4,176,413 | 12/1979 | Whitney et al. | 4/353 X |

FOREIGN PATENT DOCUMENTS

| | | | |
|---|---|---|---|
| 176337 | 12/1905 | Germany | 4/420 |
| 455 519 | 1/1928 | Germany . | |
| 3042001 | 7/1981 | Germany . | |
| 3809946 | 10/1989 | Germany . | |
| 588 658 | 6/1977 | Switzerland . | |
| 287 564 | 10/1928 | United Kingdom . | |

*Primary Examiner*—Robert M. Fetsuga

[57] ABSTRACT

The flushing device has a flushing water tank with a closure, which is to be opened to trigger a flushing. The closure is arranged at water outlet openings of the toilet bowl. The toilet ring of the toilet bowl can thus accommodate part of the flushing water needed for the flushing. The flush tank proper can thus be made substantially smaller and flushing will be less noisy, because air noises are avoided during the flow of flushing water into the toilet ring.

14 Claims, 3 Drawing Sheets

FLUSHING MEANS AT A LAVATORY INSTALLATION HAVING A TOILET BOWL

FIELD OF THE INVENTION

The present invention pertains to a flushing means at a lavatory installation having a toilet bowl, with a flushing water tank, which has a closure, which is to be opened to trigger a flushing.

BACKGROUND OF THE INVENTION

Flushing means of this type have been generally known. In such flushing means, the flushing water tank is a flush tank in which a certain amount of water is stored for flushing the toilet bowl. Upon opening a drain valve, this water flows through a flushing elbow and into the toilet ring of the toilet bowl and through the water outlet openings of this toilet ring into the toilet bowl. Such flush tanks are substantially less noisy than so-called pressurized flushing valves, in which the flushing water flows into the toilet bowl directly from a pressure pipe. However, flush tanks have the drawback that they are relatively bulky and correspondingly require much space.

SUMMARY AND OBJECT OF THE INVENTION

The basic object of the present invention is to provide a flushing means of the above-mentioned type, which have even less noise with an at least equal flushing effect and also requires less space.

This object is accomplished in a flushing means of this class by the closure being arranged at the water outlet openings of the toilet bowl. In the flushing means according to the present invention, the closure is not located, as is usual, in the bottom of a flush tank, but at the water outlet openings of the toilet bowl. When viewed in the direction of flushing, the closure is consequently moved farther down into the toilet bowl in the flushing means according to the present invention. The toilet ring thus also forms an area of the water tank and correspondingly accommodates part of the necessary flushing water. The tank for the flushing water can be made smaller corresponding to this amount and it can therefore be made more compact. Since the toilet ring is filled with flushing water already before a flushing is triggered, the hitherto unavoidable air noises during the flow of the flushing water into the toilet ring are avoided. The flushing means according to the present invention therefore makes it possible to substantially reduce the noise generation during flushing even more.

A flushing elbow is not necessary in the flushing means according to the present invention. As a result, the hitherto unavoidable loss of energy in the flushing elbow is avoided. The same flushing effect can thus be achieved in the flushing means according to the present invention at a lower water pressure level.

An especially compact and space-saving flushing means is obtained according to a variant of the present invention if the flushing water tank forms one unit with the toilet ring. If the toilet ring is designed as a toilet seat according to a variant of the present invention, inexpensive manufacture and at the same time also simple mounting are achieved. Thus, the toilet ring now forms part of the water tank and can be mounted with same on the toilet bowl. However, a design in which the toilet ring is part of the toilet bowl is also possible. This ring may consist of ceramic or even an attached ring made of plastic.

An especially advantageous closure is obtained for the water outlet openings if the closure has a membrane, which is in contact with the outlet openings of the flushing water tank and can be lifted off from these openings to trigger the flushing. This membrane is preferably designed as a flexible tube and extends into the toilet ring of the toilet bowl. An especially simple actuation of the closure is guaranteed if the membrane can be connected to a water pipe and can be filled with tap water and can be expanded for the closure of the outlet openings. The pressure in this flexible tube-like membrane is then reduced on triggering a flushing. This is preferably performed with a valve, by which the membrane is connected to the water pipe in one position and to the ambient air in another position.

According to a variant of the present invention, the flushing water tank is formed by an annular area and a box-like area, wherein part of the flushing water is stored in the annular area and one part of the flushing water is stored in the box-like area, and the two areas are connected to one another. The annular area forms the toilet ring and the box-like area is preferably arranged at the rear end of this ring. Since an essential part of the flushing water is located in the annular area, the box-like area is made substantially smaller than a usual flush tank. This annular area may be made of a plastic and may form the top edge of the toilet bowl. Since the toilet ring of the toilet bowl does not need to be made of ceramic in this case, such a toilet bowl can be manufactured substantially more simply and at a lower cost. The toilet edge and the toilet bowl as well as the toilet seat may thus be formed by the annular area of the flushing water tank.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
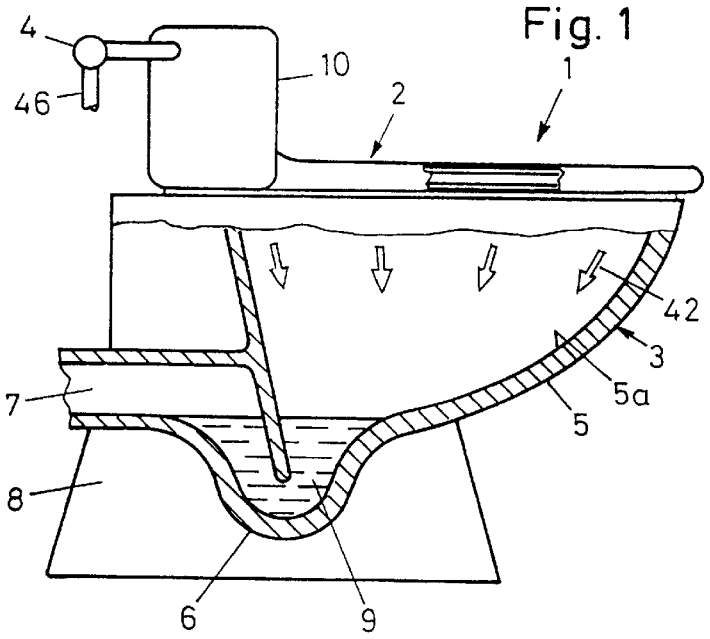
FIG. 1 shows a partial sectional view of a flushing means according to the present invention at a lavatory installation.

FIG. 1 shows a lavatory installation 1 with a flushing means 2 and a ceramic part 3, which has in the usual manner a foot 8, a siphon 6 with siphon water 9 as well as a soil pipe connection 7. The ceramic part 3 has a bowl-like wall 5 with an inside 5*a*, which can be flushed with the flushing means 2, wherein the flushing water flows downward to the siphon 6 along the inside 5*a* in the direction of the parts 42. The siphon 6 is emptied and subsequently filled here in the known manner.

Figure 2:
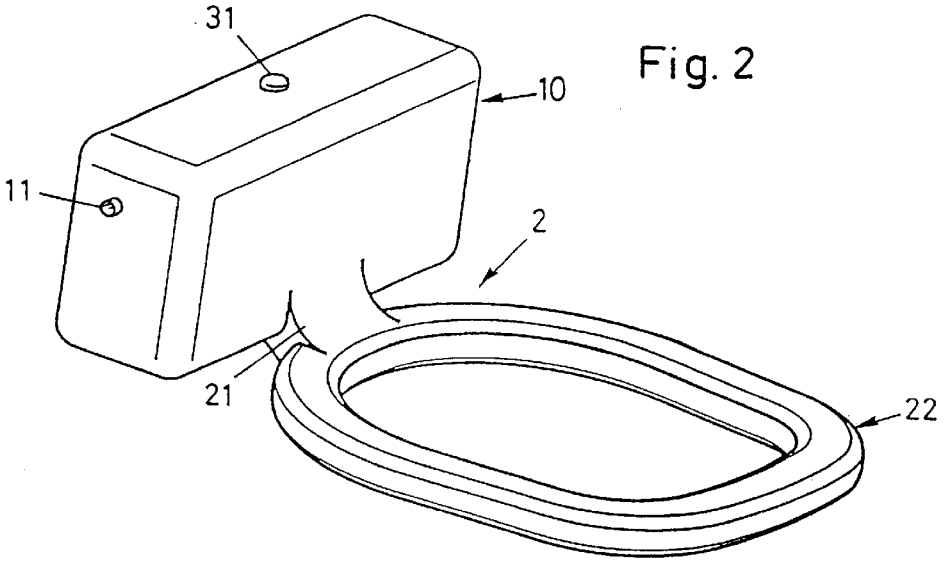
FIG. 2 shows a three-dimensional view of the flushing means.
Figure 3:
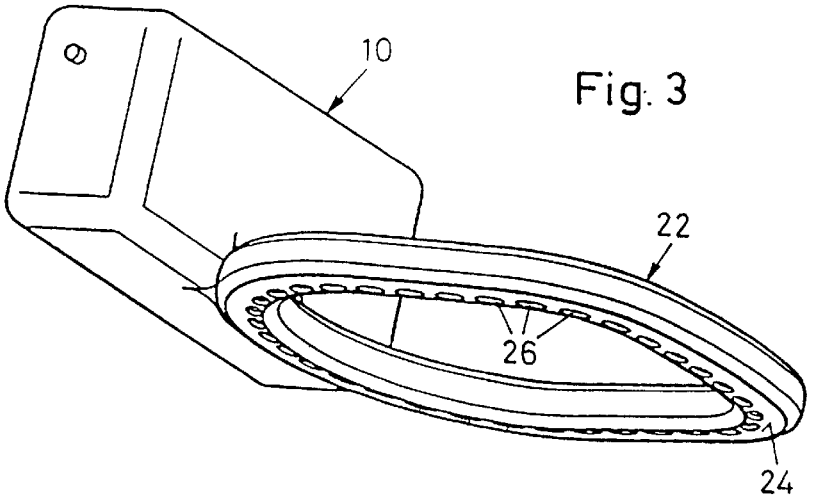
FIG. 3 shows another view of the flushing means.
Figure 4:
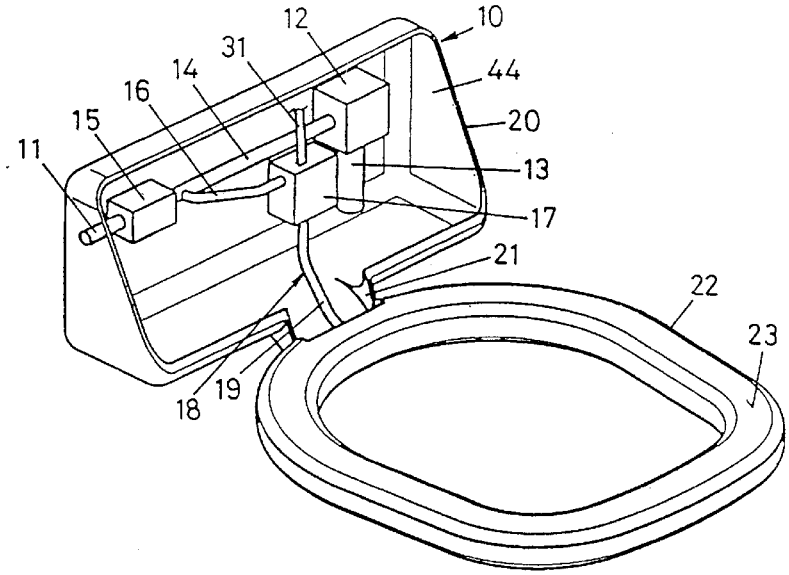
FIG. 4 shows another view of the flushing means, wherein part of the flushing water tank is cut away.

The flushing means 2 is placed on a top edge 43 of the ceramic part 3 and forms, according to FIGS. 2 through 4, a unit comprising essentially a tank 10 and an annular seat 22. The tank 10 and the seat 22 are connected to one another by a short channel 21. As is shown especially in FIG. 3, a plurality of flushing openings 26 are arranged at spaced locations from one another on the underside of the seat 22. As can be seen, these openings 26 are distributed over the entire underside 24 of the seat 22. The flushing openings 26 may be round, especially circular openings or even slots.

Figure 5:
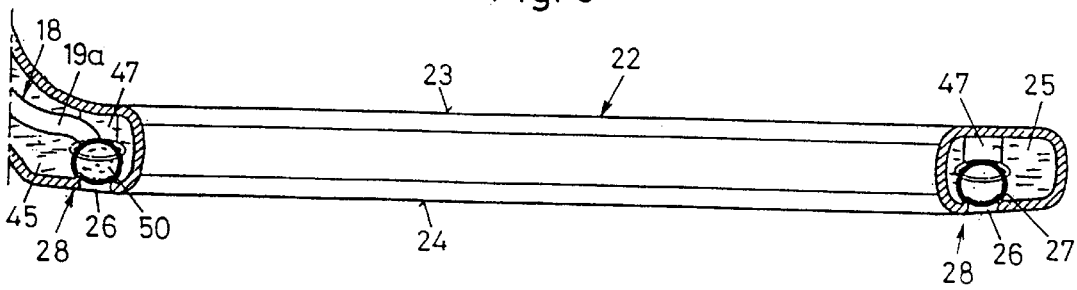
FIGS. 5 and 6 show sections of the flushing means to explain the mode of operation of the closure, FIGS. 7 and 8 schematically show a sectional view of a flushing valve, FIG. 9 schematically shows a section through a variant of the flushing means.
Figure 6:
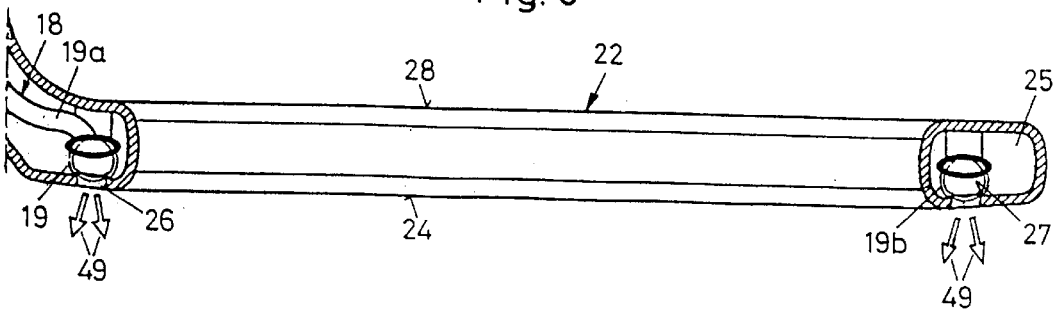

According to FIGS. 5 and 6, the flushing openings 26 are connected to a channel 25, which extends inside the seat 22 in the circumferential direction and is connected to an interior space 44 of the tank 10 via the channel 21. These openings 26 can be closed with a flexible tube-like membrane 19 of a closing member 18. The openings 26 thus form a closure with the closing member 18, and the said closure closes the interior space of the channel 25 to the outside. The membrane 19 forms a ring 19*b*, which leads at a rear end of the seat 22 via a flexible tube section 19*a* to a flush valve 17, which is arranged inside the tank 10 according to FIG. 4. The membrane 19 occupies only a comparatively small part of the channel 25. This channel 25 accommodates a substantial part of the flushing water 45, as is indicated in FIG. 5. The other part of the flushing water 45 is located in the interior space 44 of the tank 10. The two amounts of water are in connection with one another via the channel 21.

The flush valve 17 is connected via a pipe 16 to a pipe 14, which is connected via the valve 15 to an end 11 projecting from the housing 20 of the tank 10. According to FIG. 1, this end 11 is connected in the usual manner to a corner valve 4 of a supply pipe 46. To actuate the flush valve 17, e.g., a button 31 is arranged thereon, which is accessible from the outside of the tank 10 according to FIG. 2 and is pressed downward to trigger a flushing. However, other mechanical or even electric triggering, e.g., remote triggering, is also possible.

Figure 7:
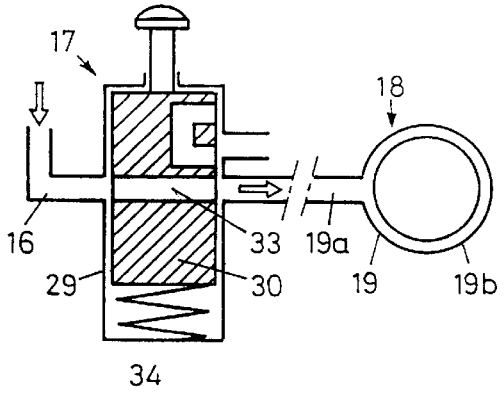
Figure 8:
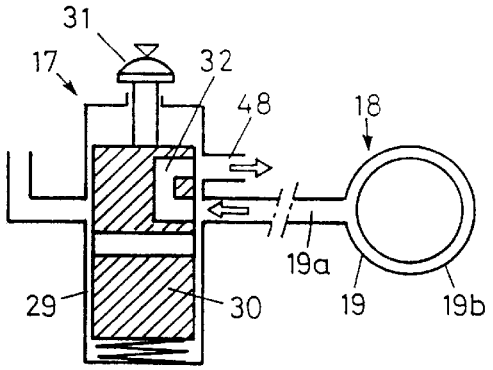

According to FIGS. 7 and 8, the flush valve 17 has a housing 29, in which a valve body 30 is mounted. The button 31 is arranged at the top end of the valve body 30, and a resetting spring 34 is arranged at the lower end. The resetting of the valve body 30 is performed in the known manner by self-closure, e.g., according to CII-A 588658 and U.S. Pat. No. 2,629,401. In the position shown in FIG. 7, a passage 33 connects the pipe 16 to the closing member 18. The membrane 19 is thus connected to the pipe 16 in this position of the flush valve 17 and is filled with pressurized water from the supply pipe 46. Thus, a water pressure that holds the membrane in an expanded position indicated in FIG. 5 is present inside the membrane 19. Thus, the annular area of the membrane 19 has, e.g., an approximately circular cross section, as is indicated by solid lines in FIG. 5. The membrane 19 is supported on the top side at a plurality of projections 47 arranged in the channel 25 and seals the flushing openings 26 at valve seats 27 arranged on the inside due to its inner pressure. The valve body 30 is held by the spring 34 in the position shown in FIG. 7. The intake valve is likewise connected to the supply pipe 46 via the pipe 14.

To trigger flushing, the valve body 30 is moved downward by means of the button 31 against the force of the spring 34 into the position shown in FIG. 8. In this position, the membrane 19 is connected to an outwardly open pipe branch 48 of the housing 29 via a connection channel 32. The inner pressure in the membrane 19 is lowered as a result, because the membrane 19 is no longer connected to the pipe 16. Due to the elasticity of the membrane 19, the annular area 19*b* regains a shape in which the cross section is substantially reduced and in which the flushing openings 26 are no longer sealed against the channel 25, as is shown in FIG. 6. The relaxed position of the membrane 19 is shown by solid lines in FIG. 6. The broken lines indicate the tensioned and sealing membrane 19 here. Since the flushing openings 26 are now free, the flushing water 45 flows downward at these openings 26 in the direction of the arrows 49 and into the bowl 5 of the ceramic 3. The flushing process is terminated when the flushing water 45 has flown completely into the bowl 5 and the channel 25 as well as the interior space 44 of the tank 10 have been emptied. The amount of his rushing water is, e.g., 6 L or less. After flushing, a float 13 of the intake valve 12 initiates the refilling of the flushing means 2 with flushing water. At the same time, the valve body 30 returns into the position shown in FIG. 7, the membrane 19 is inflated again due to the said membrane 19 being connected to the pipe 16 and it closes the flushing openings 26. As soon as the channel 25 and the tank 10 have been refilled with flushing water, the float 13 closes the intake valve 12. The flushing means 2 is thus again ready for another flushing.

The flushing means 2 is manufactured separately from the ceramic 3 as a unit essentially from plastic. The seat surface 22 is placed on the top edge 43 of the ceramic 3 and is fastened by means of fastening means, not shown here. A cover, not shown here, which covers the opening of the seat 22, may be arranged on the flushing means 2 at the same time. This cover lies on the top side of the seat 22. The seat 22 thus replaces the usual toilet ring, which form [sic - Tr.Ed.] the upper edge of the ceramic 3 in the prior-art lavatory installations.

Figure 9:
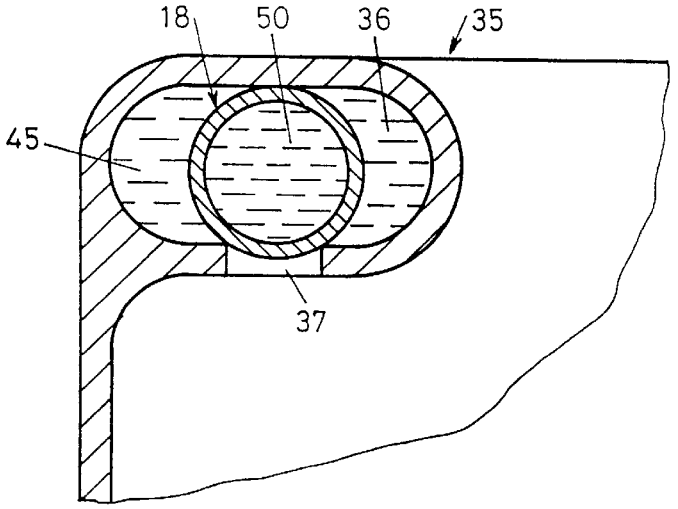
Figure 10:
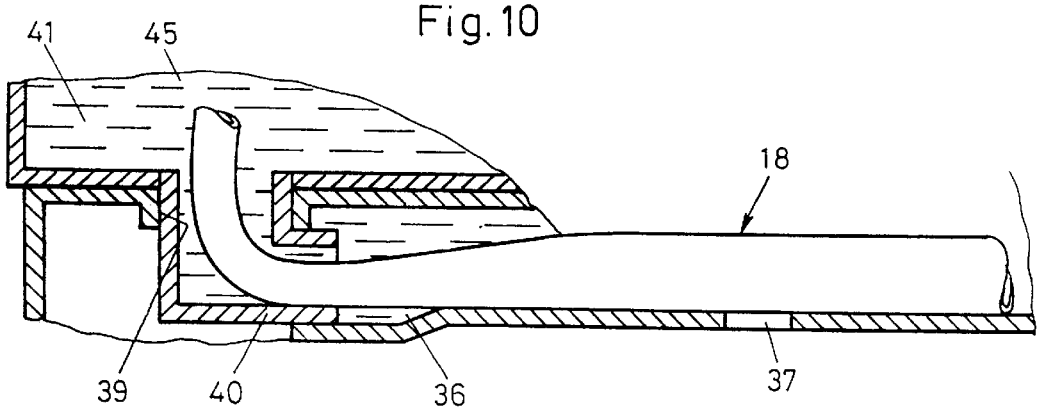
FIG. 10 shows another section through part of the flushing means according to FIG. 9.

FIGS. 9 and 10 show an embodiment in which the closing member 18 extends in a channel 36 of the toilet bowl 35. The channel 36 forms an area made integrally in one piece here and thus the upper edge of the ceramic bowl 35. A plurality of flushing openings 37, which correspond to the openings 26, are correspondingly arranged in this edge on the underside. The closing member 18 extends over the entire area of the channel 36 and operates as above to close the openings 37 and to release them for flushing. As is shown in FIG. 10, the closing member 18 is introduced into the tank 10 at a pipe branch 40 of the tank 10. To connect the pipe branch 40 to the channel 36, the bowl 35 has an opening 39 at a rear end, through which opening the pipe branch 40 is introduced. The pipe branch 40 is tightly connected to the channel 36 with means not shown here.

While specific embodiments of the invention have been shown and described in detail to illustrate the application of the principles of the invention, it will be understood that the invention may be embodied otherwise without departing from such principles.

I claim:

1. A flushing means at a lavatory installation having a toilet bowl, comprising a flushing water tank, which has a closure, which is to be opened to trigger a flushing, wherein the closure is arranged at a plurality of water outlet openings of said toilet bowl.

2. A flushing means in accordance with claim 1, wherein said flushing water tank forms a unit with a toilet ring.

3. A flushing means in accordance with claim 2, wherein said toilet ring is designed as a toilet seat.

4. A flushing means in accordance with claim 1, wherein an interior space of said flushing water tank extends up to a plurality of outlet openings arranged in said toilet ring.

5. A flushing means in accordance with claim 1, wherein said closure has a membrane, which can be lifted off from said water outlet openings to trigger the flushing.

6. A flushing means in accordance with claim 5, wherein said membrane is designed as a flexible tube in some areas and extends into a channel of said toilet ring.

7. A flushing means in accordance with claim 5, wherein said membrane is connected to a supply pipe and can be filled with tap water and can be expanded to close said outlet openings.

8. A flushing means in accordance with claim 1, wherein said flushing water tank is formed by an annular area and a box-like area, where part of said flushing water is stored in said annular area and part of said flushing water is stored in said box-like area and said two areas are connected to one another.

9. A flushing means in accordance with claim 8, wherein said annular area forms an edge of said toilet bowl.

10. A flushing means in accordance with claim 8, wherein said annular area forms a toilet seat.

11. A flushing means in accordance with claim 8, wherein said water outlet openings are arranged on the underside of said annular area.

12. A flushing means in accordance with claim 8, wherein said water outlet openings are round holes or slots.

13. A flushing means in accordance with claim 8, wherein said annular area is arranged at a box-like tank part and said box-like tank part is essentially as wide as said annular area and is substantially less high than it is wide.

14. A flushing means in accordance with claim 12, wherein said box-like area is arranged firmly at and is especially made in one piece with said annular area.

* * * * *